US010689739B2

(12) United States Patent
Danielou et al.

(10) Patent No.: US 10,689,739 B2
(45) Date of Patent: Jun. 23, 2020

(54) ALUMINIUM-COPPER-LITHIUM ALLOY PRODUCTS WITH IMPROVED FATIGUE PROPERTIES

(71) Applicant: CONSTELLIUM FRANCE, Paris (FR)

(72) Inventors: Armelle Danielou, Les Echelles (FR); Soizic Blais, Saint Etienne de Crossey (FR); Philippe Jarry, Grenoble (FR); Olivier Ribaud, Renage (FR); Bernard Valentin, Voiron (FR)

(73) Assignee: Constellium Issoire, Issoire (FR)

( * ) Notice: Subject to any disclaimer, the term of this patent is extended or adjusted under 35 U.S.C. 154(b) by 255 days.

(21) Appl. No.: 14/566,810

(22) Filed: Dec. 11, 2014

(65) Prior Publication Data

US 2016/0237532 A1 Aug. 18, 2016

(30) Foreign Application Priority Data

Dec. 13, 2013 (FR) ..... 13 02932

(51) Int. Cl.
*C22F 1/057* (2006.01)
*C22C 21/12* (2006.01)
(Continued)

(52) U.S. Cl.
CPC ..... *C22F 1/057* (2013.01); *B21B 1/22* (2013.01); *B21C 23/212* (2013.01); *B21J 5/00* (2013.01);
(Continued)

(58) Field of Classification Search
CPC ..... C22C 21/12; C22C 21/16; B22D 21/04; C22F 1/057
See application file for complete search history.

(56) References Cited

U.S. PATENT DOCUMENTS 4,769,158 A 9/1988 Eckert
5,032,359 A 7/1991 Pickens
(Continued)

FOREIGN PATENT DOCUMENTS

CN 201077859 Y 6/2008
EP 1504834 A1 2/2005
(Continued)

OTHER PUBLICATIONS

Anderson, Kevin, ASM Handbook, vol. 2B, "Properties and Selection of Aluminum Alloys". (Year: 2019).*
(Continued)

*Primary Examiner* — George Wyszomierski
*Assistant Examiner* — Janell C Morillo
(74) *Attorney, Agent, or Firm* — McBee Moore & Vanik IP, LLC

(57) ABSTRACT

The disclosure provides for plate having a thickness of at least 80 mm comprising aluminium alloy as a percentage by weight %: Cu: 2.0-6.0; Li: 0.5-2.0; Mg: 0-1.0; Ag: 0-0.7; Zn 0-1.0; and at least one element selected from Zr, Mn, Cr, Sc, Hf and Ti, the amount of said element, if selected, being 0.05 to 0.20 wt % for Zr, 0.05 to 0.8% wt % t for Mn, 0.05 to 0.3 wt % for Cr and for Sc, 0.05 to 0.5 wt % Hf and 0.01 to 0.15% wt % for Ti, Si≤0.1; Fe≤0.1; others ≤0.05 each and ≤0.15 in total, wherein the aged state logarithmic fatigue mean measured at mid-thickness in the LT direction on smooth specimens with a maximum stress amplitude of 242 MPa, a frequency of 50 Hz, a stress ratio of R=0.1 of at least 250,000 cycles.

21 Claims, 6 Drawing Sheets

(51) Int. Cl.

| | |
|---|---|
| ***C22C 21/16*** | (2006.01) |
| ***C22C 21/18*** | (2006.01) |
| ***B22D 11/00*** | (2006.01) |
| ***B22D 11/041*** | (2006.01) |
| ***B21B 1/22*** | (2006.01) |
| ***B21C 23/21*** | (2006.01) |
| ***B21J 5/00*** | (2006.01) |
| ***B22D 11/04*** | (2006.01) |
| ***B22D 11/059*** | (2006.01) |
| ***B22D 21/00*** | (2006.01) |
| ***C22C 1/02*** | (2006.01) |
| ***C22C 21/14*** | (2006.01) |
| *B21B 3/00* | (2006.01) |

(52) U.S. Cl.

CPC ..... *B22D 11/003* (2013.01); *B22D 11/041* (2013.01); *B22D 11/0408* (2013.01); *B22D 11/059* (2013.01); *B22D 21/007* (2013.01); *C22C 1/026* (2013.01); *C22C 21/12* (2013.01); *C22C 21/14* (2013.01); *C22C 21/16* (2013.01); *C22C 21/18* (2013.01); *B21B 2003/001* (2013.01)

(56) References Cited

U.S. PATENT DOCUMENTS

| | | | | |
|---|---|---|---|---|
| 5,207,974 | A | 5/1993 | Yun | |
| 5,383,986 | A | 1/1995 | Cho | |
| 5,415,220 | A | 5/1995 | Edwards | |
| 5,871,660 | A | 2/1999 | Xu et al. | |
| 6,270,717 | B1 | 8/2001 | Tremblay | |
| 8,365,808 | B1 * | 2/2013 | Tilak | B22D 11/003 164/415 |
| 2004/0084172 | A1 | 5/2004 | Vincent et al. | |
| 2007/0215310 | A1 | 9/2007 | Van Schooneveldt | |
| 2009/0142222 | A1 | 6/2009 | Colvin | |
| 2011/0003085 | A1 | 1/2011 | Hugener-Campbell et al. | |
| 2011/0030856 | A1 * | 2/2011 | Warner | C22C 21/00 148/552 |
| 2011/0209801 | A2 | 9/2011 | Warner | |
| 2012/0152415 | A1 | 6/2012 | Danielou | |
| 2012/0154415 | A1 | 6/2012 | Brunner et al. | |

FOREIGN PATENT DOCUMENTS

| | | | |
|---|---|---|---|
| EP | 1198314 | B1 | 12/2005 |
| FR | 2757422 | A1 | 12/1996 |
| WO | 199944719 | A2 | 1/1999 |
| WO | 2010114561 | A1 | 10/2010 |
| WO | 2015086922 | A2 | 6/2015 |

OTHER PUBLICATIONS

International Search Report from corresponding FR 1302932, received Sep. 16, 2014.

International Search Report dated Jul. 10, 2015, issued in counterpart Application No. PCT/FR2014/000273.

International Search Report Issued in PCT/FR2014/000271, dated Dec. 11, 2014.

Standard Purchase Order Supplied by Textile Product Inc to Alcoa Technology, Printed Sep. 4, 2007, pp. 1-8.

"Lend Weave", Wikipedia Page, Retrieved Jun. 19, 2019, pp. 1-2.

"Carbon Fibers", Wikipedia Page, Retrieved Jun. 11, 2019, pp. 1-5.

ASM Specialty Handbook, Aliumium and Aliuminum Alloys, ASM International (1993) p. 7.

"Molten Aluminum Processing and Casting" ASM Specialty Handbook, ASM International, (1993), pp. 199-210.

* cited by examiner

5

ALUMINIUM-COPPER-LITHIUM ALLOY PRODUCTS WITH IMPROVED FATIGUE PROPERTIES

BACKGROUND

The invention relates to rolled aluminium-copper-lithium alloys, and particularly to such products and methods for their manufacture and use, especially for aircraft and aerospace construction.

DESCRIPTION OF RELATED ART

Rolled aluminium alloy products are developed to produce structural elements for the aircraft industry and the aerospace industry in particular.

Aluminium-copper-lithium alloys are particularly promising for the manufacture of this type of product. The specifications imposed by the aircraft industry for fatigue resistance are demanding. For thick products it is particularly difficult to attain these specifications. Because of the possible thicknesses of cast slabs, the reduction in thickness by hot working is quite low and therefore the sites related to casting on which fatigue cracks begin do not get smaller during hot working.

As lithium is particularly susceptible to oxidation, casting of aluminium-copper-lithium alloys generally generates more sites on which fatigue cracking begins than for alloys of type 2XXX without lithium or 7XXX. The solutions usually found for obtaining thick rolled products made of alloys of type 2XXX without lithium or 7XXX do not give adequate fatigue properties for aluminium-lithium-copper alloys.

Thick products made of Al—Cu—Li alloys are described in applications US2005/0006008 and US2009/0159159, both of which are incorporated by reference in their entirety.

In application WO2012/110717, it is proposed, in order to improve the properties, especially fatigue properties, of aluminium alloys containing in particular at least 0.1% Mg and/or 0.1% Li, to perform ultrasound treatment during casting. But this type of treatment is difficult to carry out for the quantities necessary for the manufacture of thick plates.

US Application 2009/0142222 describes alloys that may include 3.4-4.2% by weight of Cu, 0.9 to 1.4 wt % Li, 0.3-0.7 wt % Ag, from 0.1 to 0.6% by weight of Mg, from 0.2 to 0.8 wt % of Zn, 0.1 to 0.6 wt % of Mn and 0.01 to 0.6 wt. % of at least element controlling the grain structure, the balance being aluminum, incidents elements and impurities.

There is a need for thick aluminium-copper-lithium alloy products having improved properties compared to those of known products, particularly in terms of fatigue properties, while having advantageous fracture toughness and static mechanical strength properties. In addition there is a need for a simple and economical method of obtaining these products.

SUMMARY

A first subject of the invention is a method of manufacturing a plate, having a thickness of at least 80 mm, made of an aluminium alloy comprising steps in which (a) a bath of molten alloy metal is prepared comprising, as a percentage by weight, Cu: 2.0-6.0; Li: 0.5-2.0; Mg: 0-1.0; Ag: 0-0.7; Zn 0-1.0; and at least one element selected from Zr, Mn, Cr, Sc, Hf and Ti, the amount of said element, if selected, being 0.05 to 0.20 wt % for Zr, 0.05 to 0.8% wt % t for Mn, 0.05 to 0.3 wt % for Cr and for Sc, 0.05 to 0.5 wt % Hf and 0.01 to 0.15% wt % for Ti, Si≤0.1; Fe≤0.1; others ≤0.05 each and ≤0.15 in total, (b) said alloy is cast by vertical semi-continuous casting to obtain a slab of thickness T and width W so that upon solidification, the hydrogen content of said molten metal bath (1) is less than 0.4 ml/100 g, the oxygen content measured above the liquid surface (14, 15) is less than 0.5% by volume, the distributor device (7) used for casting is made of fabric comprising carbon; it comprises a lower face (76), an upper face defining the opening through which the molten metal is introduced (71) and a wall of substantially rectangular section, the wall comprising two longitudinal portions parallel with width W (720, 721) and two transverse portions parallel with thickness T (730, 731), said transverse and longitudinal portions being formed from at least two fabrics, a first substantially sealing and semi-rigid fabric (77) ensuring that the distributor device keeps its shape during casting, and a second non-sealing fabric (78) allowing the passage and filtration of liquid, said first and second fabrics being bonded to each other without overlap or with overlap and no gap separating them, said first fabric continuously covering at least 30% of the surface of said wall portions (720, 721, 730, 731) and being positioned so that the liquid surface is in contact therewith over the entire section, (c) said slab is homogenized before or after optionally machining it to obtain a rolling ingot that can be hot-worked, (d) said rolling ingot, homogenized in this way, is hot rolled and optionally cold worked to obtain a plate, having a thickness of at least 80 mm, (e) said plate undergoes solution heat treatment and quenching, (f) optionally said plate that has undergone solution heat treatment is stress-relieved by plastic deformation with a deformation of at least 1%, and (g) said solution heat-treated and optionally stress-relieved plate is subjected to aging.

Another subject of the invention is a plate having a thickness of at least 80 mm, obtainable by the method of the invention, made of aluminium alloy comprising, as a percentage by weight %, Cu: 2.0-6.0; Li: 0.5-2.0; Mg: 0-1.0; Ag: 0-0.7; Zn 0-1.0; and at least one element selected from Zr, Mn, Cr, Sc, Hf and Ti, the amount of said element, if selected, being 0.05 to 0.20 wt % for Zr, 0.05 to 0.8% wt % t for Mn, 0.05 to 0.3 wt % for Cr and for Sc, 0.05 to 0.5 wt % Hf and 0.01 to 0.15% wt % for Ti, Si≤0.1; Fe≤0.1; others ≤0.05 each and ≤0.15 in total, characterized in that in the aged state its fatigue logarithmic mean measured at mid-thickness in the LT direction on smooth test samples as shown in FIG. 1*a* with a maximum stress amplitude of 242 MPa, a frequency of 50 Hz, a stress ratio of R=0.1 is at least 250,000 cycles.

Still another subject of the invention is the use of a plate according to the invention for producing an aircraft structural element, preferably a spar, a rib or a frame.

DETAILED DESCRIPTION OF A PREFERRED EMBODIMENT

Unless otherwise stated, all information regarding the chemical composition of the alloys is expressed as a percentage by weight based on the total weight of the alloy. The expression 1.4 Cu means that the copper content expressed as a percentage by weight is multiplied by 1.4. Alloy designation is made in accordance with the regulations of The Aluminium Association, known to specialists in the field. Unless otherwise stated, the definitions of tempers listed in European standard EN 515 will apply.

Static tensile mechanical properties, in other words, the ultimate tensile strength $R_m$, the conventional yield stress at 0.2%, the elongation limit $R_{p0,2}$, and elongation at rupture A %, are determined by a tensile test according to NF EN ISO 6892-1, sampling and direction of testing being defined by EN 485-1.

The stress intensity factor ($K_{1C}$) is determined according to standard ASTM E 399.

Figure 1A:
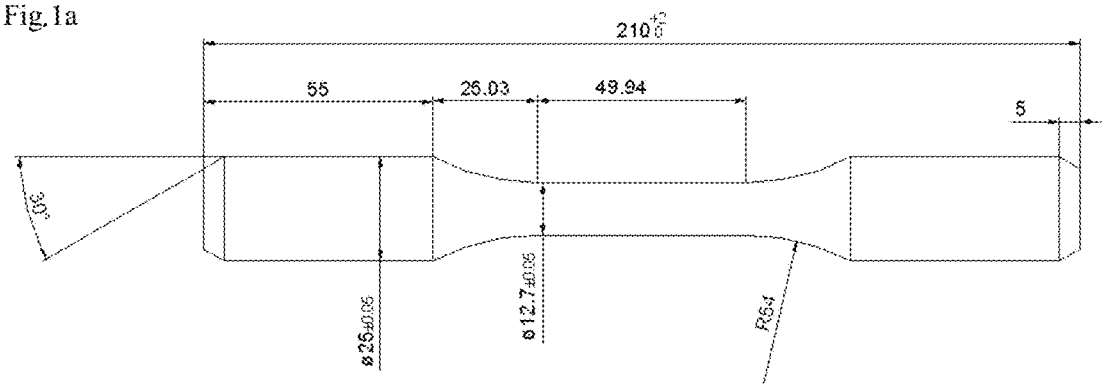
FIG. 1 is a diagram of the test samples used for smooth (FIG. 1*a*) and notched (FIG. 1*b*) fatigue testing. Dimensions are given in mm.

Fatigue properties on smooth test samples were measured in ambient air at a maximum stress amplitude of 242 MPa, a frequency of 50 Hz, and a stress ratio of R=0.1, on test samples as shown in FIG. 1*a*, taken at mid-width and mid-thickness of plates in the LT direction. The test conditions are compliant with standard ASTM E466. The logarithmic mean of the results obtained is determined on at least four specimens.

Figure 1B:
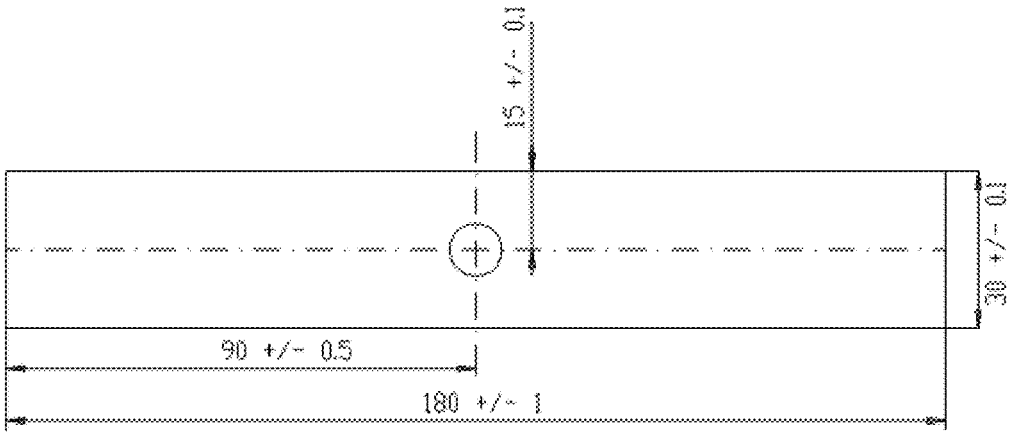

The fatigue properties of notched specimens are measured in ambient air for varying levels of stress, at a frequency of 50 Hz, and a stress ratio of R=0.1, on test specimens as shown in FIG. 1*b*, $K_t$=2.3, taken at the centre and mid-thickness of the plates in the direction L-T and T-L. The Walker equation was used to determine a maximum stress value representative of 50% of non-ruptures at 100,000 cycles. To do this, a fatigue quality index (FQI) is calculated for each point of the Wöhler curve with the formula $$IQF = \sigma_{max}\left(\frac{N_0}{N}\right)^{1/n}$$

where $\sigma_{max}$ is the maximum stress applied to a given sample, N is the number of cycles to rupture, $N_0$ is 100,000 and n=−4.5. The FQI corresponding to the median, or 50% rupture for 100,000 cycles, is reported.

In the context of the invention, a thick plate is a product whose thickness is at least 75 mm, 80 mm, and preferably at least 100 mm. In one embodiment of the invention the thickness of the plates is at least 120 mm or preferably 140 mm. The thickness of the thick plates according to the invention is typically at most 240 mm, generally at most 220 mm and preferably at most 180 mm.

In another aspect, the disclosure provides for a thick plate product described herein with a thickness of at least about 75 mm, about 80 mm, about 85 mm, about 90 mm, about 100 mm, about 120 mm, or about 140 mm. In yet another aspect, the disclosure provides for a thick plate product described herein with a thickness of at least from about 75 mm to about 120 mm, from about 80 mm to about 120 mm, from about 80 mm to about 140 mm, from about 80 mm to about 180 mm, or from about 80 mm to about 220 mm.

Unless stated otherwise, the definitions of standard EN 12258 apply. In particular, a plate is according to the invention a rolled product of rectangular cross-section, whose uniform thickness is at least 6 mm and not more than 1/10th of the width.

As used herein, "structure element" or "structural element" of a mechanical construction refers to a mechanical part for which static and/or dynamic mechanical properties are particularly important for the performance of the structure, and for which a structure calculation is usually prescribed or performed. These are typically elements whose failure could endanger the safety of said construction, its users or other people. For an aircraft, these structural elements include the elements that make up the fuselage (such as the fuselage skin, stringers, bulkheads and circumferential frames), the wings (such as the wing skin, stringers or stiffeners, ribs and spars), and the tail unit, which is made up of horizontal and vertical stabilizers, and floor beams, seat tracks and doors.

Here, "the entire casting facility" refers to all devices for converting a metal in any form into a raw semi-finished product via the liquid phase. A casting plant may include many devices such as one or more furnaces needed for melting metal ("smelters") and/or keeping it at a given temperature ("holding furnace") and/or operations for preparing the liquid metal and adjusting the composition ("production furnace"), one or more vessels (or "ladles") for removing impurities dissolved and/or suspended in the molten metal; this treatment may involve filtering the liquid metal through a filter medium in a "filter bag" or introducing into the bath a "treatment" gas that may be inert or reactive in a "reaction vessel", a device for solidifying the liquid metal (or "casting machine"), by semi-continuous direct chill vertical casting into a casting pit, which may include devices such as a mould (or "ingot mould"), a device for supplying liquid metal (or "spout") and a cooling system, these furnaces, vessels and solidification devices being interconnected by transfer devices or channels called "troughs" in which the liquid metal may be carried.

The present inventors have surprisingly found that thick plates of aluminium copper lithium alloy can be obtained that have improved fatigue performance by preparing these plates using the following method.

In the first step, a bath of molten alloy metal is prepared comprising, as a percentage by weight, Cu: 2.0-6.0; Li: 0.5-2.0; Mg: 0-1.0; Ag: 0-0.7; Zn 0-1.0; and at least one element selected from Zr, Mn, Cr, Sc, Hf and Ti, the amount of said element, if selected, being 0.05 to 0.20 wt % for Zr, 0.05 to 0.8% wt % t for Mn, 0.05 to 0.3 wt % for Cr and for Sc, 0.05 to 0.5 wt % Hf and 0.01 to 0.15% wt % for Ti, Si≤0.1; Fe≤0.1; others ≤0.05 each and ≤0.15 in total, remainder aluminium.

A advantageous alloy for the method according to the invention comprises, as a percentage by weight, Cu: 3.0-3.9; Li: 0.7-1.3; Mg: 0.1 to 1.0, at least one element selected from Zr, Mn and Ti, the amount of said element, if selected, is from 0.06 to 0.15 wt % for Zr, 0.05 to 0.8 wt % for Mn and 0.01 to 0.15% by weight for Ti; Ag: 0-0.7; Zn≤0.25; Si≤0.08; Fe≤0.10; others ≤0.05 each and ≤0.15 in total, remainder aluminium.

Advantageously, the copper content is at least 3.2% by weight. In another aspect, the copper content is between about 3.2 and 3.6% by weight. The lithium content is preferably between 0.85 and 1.15% by weight and preferably between 0.90 and 1.10% by weight. The magnesium content is preferably between 0.20 and 0.6% by weight. Simultaneous addition of manganese and zirconium is generally advantageous. Preferably the manganese content is between 0.20 and 0.50% by weight and the zirconium content is between 0.06 and 0.14% by weight. The silver content is preferably between 0.20 and 0.7% by weight. It is advantageous for the silver content to be at least 0.1% by weight. In one embodiment of the invention the silver content is at least 0.20% by weight. In another embodiment, the silver content is limited to 0.15% by weight and the zinc content is at least 0.3% by weight. In an aspect, the silver content is at most 0.5% by weight. In one embodiment of the invention the silver content is limited to 0.3% by weight. Preferably the silicon content is at most 0.05% by weight and the iron content is at most 0.06% by weight. Advantageously, the titanium content is between 0.01 and 0.08% by weight. In one embodiment of the invention the zinc content is at most 0.15% by weight.

A preferred aluminium-copper-lithium alloy is alloy AA2050.

This molten metal bath is prepared in a furnace in the casting facility. It is known, for example from U.S. Pat. No. 5,415,220 which is hereby incorporated by reference in its entirety, that molten salts containing lithium can be used, such as KCl/LiCl mixtures in the smelter to passivate the alloy while it is being transferred to the casting facility. However, the present inventors have obtained excellent fatigue properties for thick plates without the use of molten salt containing lithium in the smelter, but by keeping a low-oxygen atmosphere in this smelter, and they believe that the presence of salt in the smelter could, in some cases, have a detrimental effect on the fatigue properties of thick wrought products. Therefore, in an aspect, the disclosure provides for a method of manufacturing thick plate alloys described herein without the use of molten salt containing lithium. The disclosure also provides for products prepared by this process having improved properties as well as methods of improving the fatigue properties of thick plate products described herein. In an aspect, a molten salt containing lithium is not used throughout the entire casting facility. In an advantageous embodiment no molten salt is used throughout the casting facility. Preferably, an oxygen content less than 0.5% by volume and preferably less than 0.3% by volume. is maintained in the furnace(s) of the casting facility. However, an oxygen content of at least 0.05% by volume and even at least 0.1% by volume can be tolerated in the furnace(s) of the casting facility, which is advantageous especially for the economic aspects of the method. Advantageously the furnace(s) of the casting facility are induction furnaces. The present inventors have found that this type of furnace is advantageous despite the mixing generated by induction heating.

This bath of molten metal is then treated in a reaction vessel and a filter bag, particularly so that its hydrogen content is less than 0.4 ml/100 g and preferably less than 0.35 ml/100 g. The hydrogen content of the molten metal is measured by a commercially available appliance such as that sold under the trademark ALSCAN™, known to those skilled in the art, the probe being kept under a nitrogen sweep. Preferably the oxygen content of the atmosphere in contact with the molten metal bath in the smelter and during the degassing, filtration steps is less than 0.5% by volume and preferably less than 0.3% by volume. Preferably, the oxygen content of the atmosphere in contact with the molten metal bath is less than is less than 0.5% by volume and preferably less than 0.3% by volume for the entire casting facility. However, an oxygen content of at least 0.05% by volume and even at least 0.1% by volume can be tolerated in the entire casting facility, which is advantageous especially for the economic aspects of the method.

Figure 2:
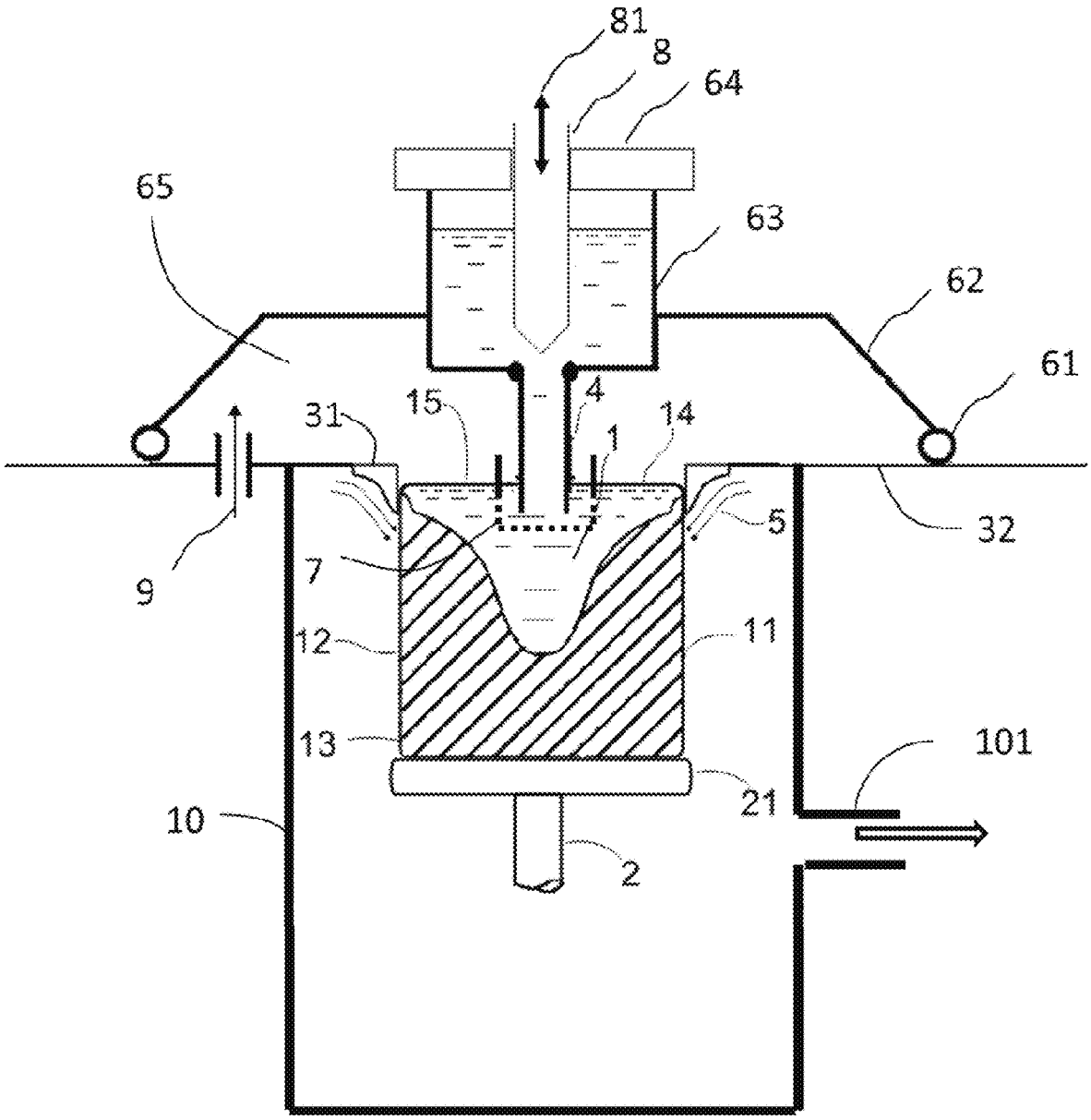
FIG. 2 is a general diagram of the solidification device used in one embodiment of the invention.

The molten metal bath is then solidified as a slab. A slab is an block of aluminium of substantially parallelepipedal shape, of length L, width W and thickness T. The atmosphere above the liquid surface is controlled during solidification. An example of a device for controlling the atmosphere above the liquid surface during solidification is shown in FIG. 2.

In this example of a suitable device, the molten metal from a trough (63) is introduced into a spout (4) controlled by a control pin (8) that can move upwards and downwards (81) in an ingot mould (31) placed on a bottom block (21). The aluminium alloy is solidified by direct cooling (5). The aluminium alloy (1) has at least one solid surface (11, 12, 13) and at least one liquid surface (14, 15). An elevator (2) keeps the level of the liquid surface (14, 15) substantially constant. A distributor device (7) is used to distribute the molten metal. A lid (62) covers the liquid surface. The lid may comprise seals (61) to ensure a leak tight seal with the casting table (32). The molten metal in the trough (63) may advantageously be protected by a lid (64). An inert gas (9) is introduced into the chamber (65) defined between the lid and the casting table. The inert gas is preferably selected from rare gases, nitrogen and carbon dioxide or mixtures of these gases. A preferred inert gas is argon. The oxygen content is measured in the chamber (65) above the liquid surface. The inert gas flow rate can be adjusted to achieve the desired oxygen content. However it is advantageous to maintain sufficient suction in the casting pit (10) by means of a pump (101). The present inventors found that there is not usually sufficient sealing between the ingot mould (31) and the solidified metal (5) which leads to a diffusion of the atmosphere from the casting pit (10) to the chamber (65). Advantageously, the suction of the pump (101) is such that the pressure in the containment (10) is less than the pressure in the chamber (65), which may be preferably obtained by imposing a speed for the atmosphere through the open areas of the casting pit of at least 2 m/s and preferably at least 2.5 m/s. Typically the pressure in the chamber (65) is close to atmospheric pressure and the pressure in the containment (10) is below atmospheric pressure, typically 0.95 times atmospheric pressure. With the method according to the invention an oxygen content of less than 0.5% by volume and preferably less than 0.3% by volume is maintained in the chamber (65), by means of the devices described.

Figure 3:
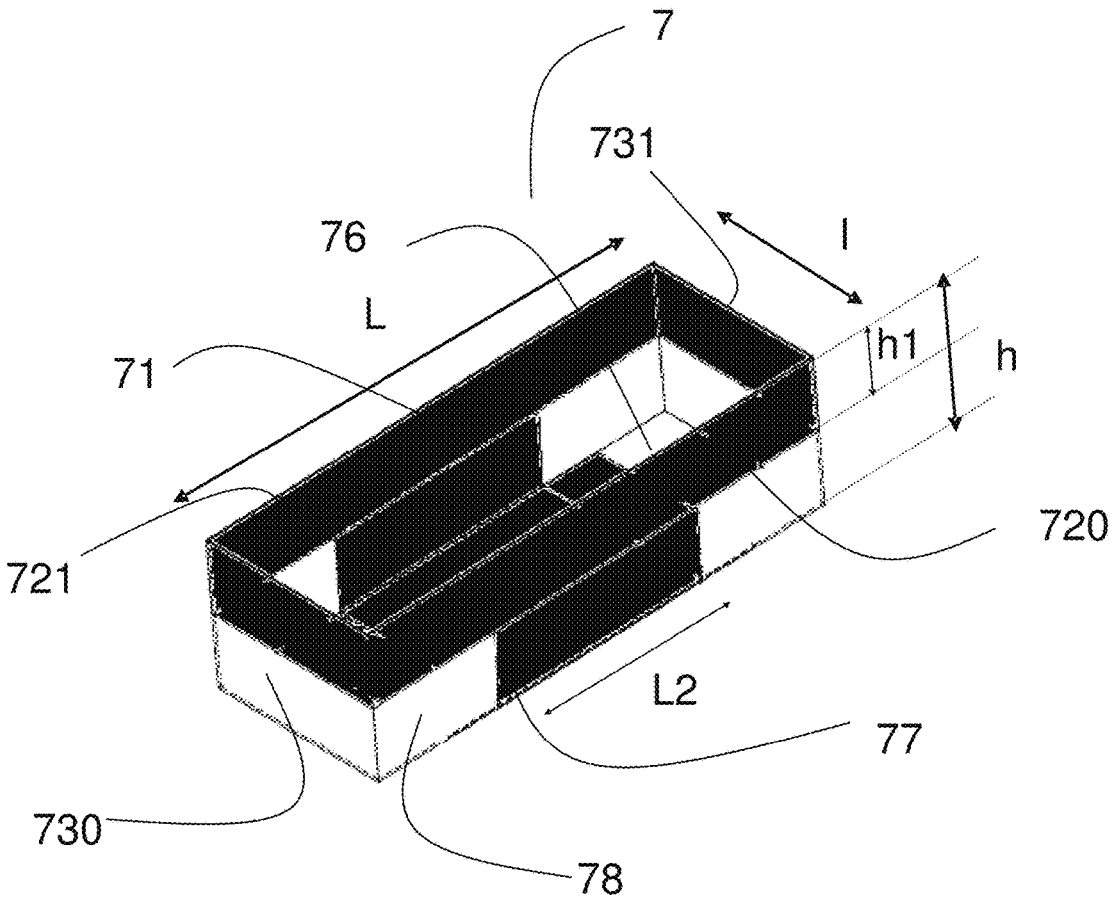
FIG. 3 is a general diagram of the distributor device used in the method according to the invention.
Figure 4:
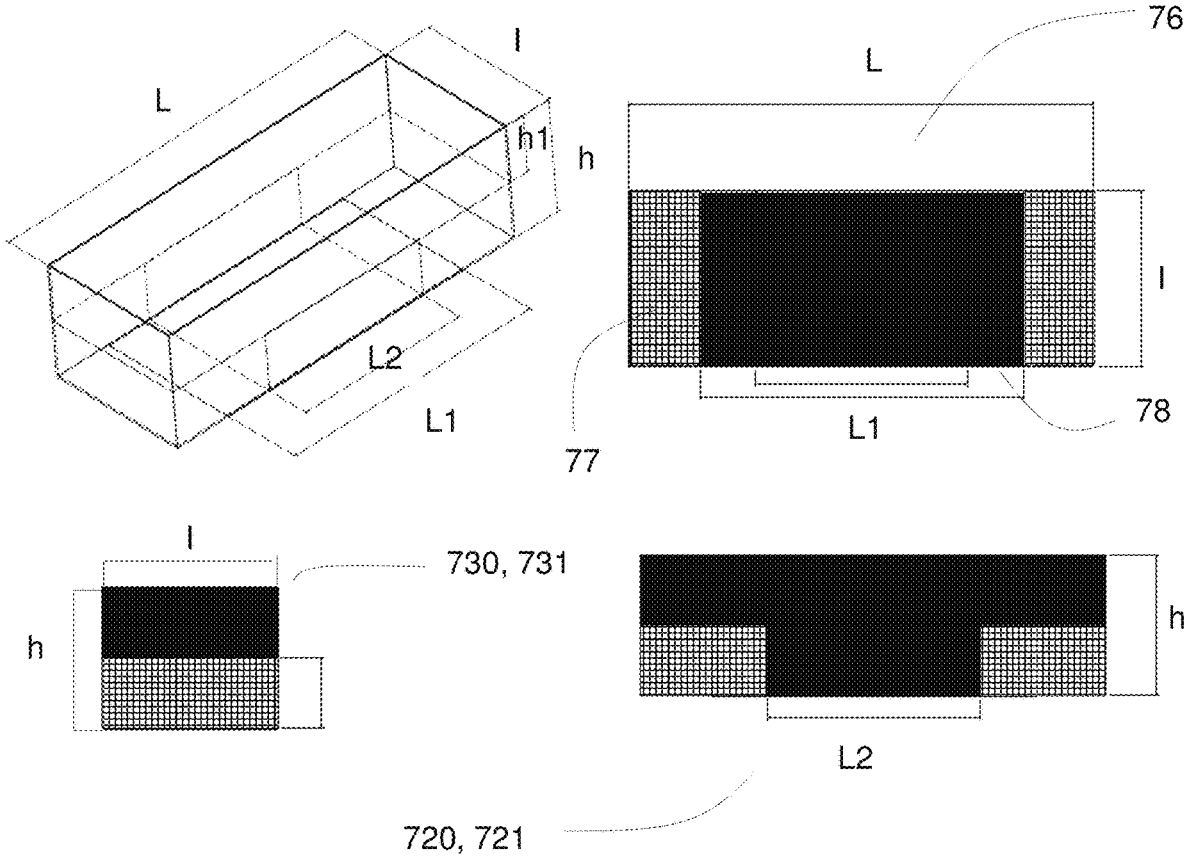
FIG. 4 shows representations of the bottom and side and longitudinal wall portions of the distributor device according to one embodiment of the invention.

An example of the distributor device (7) for the method according to the invention is shown in FIGS. 3 and 4. In an aspect, the distributor device (7) for the method according to the invention is made of a material, such as fabric comprising carbon. In an aspect, the material is a fabric comprising about 50% or more, about 60% or more, about 75% or more, or about 90% or more of carbon. It comprises a lower face (76), a typically empty upper face defining the opening through which the molten metal is introduced (71) and a wall of substantially rectangular section typically substantially constant and of height h typically substantially constant, the wall comprising two longitudinal portions parallel with width W of the slab (720, 721) and two transverse portions parallel with thickness T of the slab (730, 731), said transverse and longitudinal portions being formed of at least two fabrics, a first substantially sealing and semi-rigid fabric (77) ensuring that the distributor device keeps its shape during casting and a second non-sealing fabric (78) allowing the passage and filtration of liquid, said first and second fabrics being bonded to each other without overlap or with overlap and no gap separating them, said first fabric continuously covering at least 30% of the surface of said wall portions (720, 721, 730, 731) and being positioned so that the liquid surface is in contact therewith over the entire section. In an embodiment of the invention the section of the wall of the distributor device evolves linearly with the height h, typically so that the surface area of the lower face of the distributor device is at most 10% less or greater than or the surface area of the upper face of the distributor device; and the angle formed between verticality and sidewalls may be up to about 5°. As the first and second fabrics are stitched to each other without overlap or with an overlap and without a gap between them, i.e. in contact, the molten metal cannot pass through the first fabric and be deflected by the second fabric as is the case for example in a combo-bag as described in application WO 99/44719 which is hereby incorporated by reference in its entirety, for example, at FIGS. 2 to 5. Through the support provided by the first fabric, the distributor device is semi-rigid and does not deform substantially during casting. In an advantageous embodiment, the first fabric has a height h1 as measured from the upper face on the circumference of the wall (720, 721, 730, 731) such that h1≥0.3 h and preferably h1≥0.5 h, where h is the total height of the wall of the distributor device.

As the liquid surface is in contact with said first sealing fabric the liquid metal passes through the distributor device only under the liquid surface in certain directions of each part of the wall. Preferably the height of the wall immersed in the liquid metal (721, 720, 730, 731) of the distributor device (7) covered by the first fabric is at least 20%, preferably 40% and ideally 60% of the total height of the immersed wall.

FIG. 4 shows the bottom and longitudinal portions of the wall. The bottom (76) is typically covered by the first and/or second fabric. Advantageously, the first fabric is located at least in the central part of the bottom (76) over a length L1 and/or in the central part of the longitudinal portions (720) and (721) over the entire height h and over a length L2.

Advantageously, the surface portion covered by the first fabric is between 30 and 90% and preferably between 50 and 80% for the longitudinal portions (720) and (721), and/or between 30 and 70% and preferably between 40 and 60% for the lateral portions (730, 731) and/or between 30 and 100% and preferably between 50 and 80% for the bottom (76). It is advantageous for length L1 of the first fabric located in the bottom (76) to be greater than length L2 of the first fabric in the portion of the longitudinal walls (720) and (721) in contact with the bottom.

The present inventors believe that the geometry of the distributor device makes it possible to improve the quality of the liquid metal flow, reduce turbulence and improve temperature distribution.

The first fabric and the second fabric are preferably obtained by weaving wire comprising carbon. Woven graphite wire is particularly advantageous. The fabrics are typically sewn to each other. Instead of a first and second fabric, it is also possible to use a single fabric distributor device having at least two more or less dense weaving zones.

For ease of weaving, it is advantageous for the wire containing carbon to be coated with a layer that facilitates sliding. This layer may, for example, contain a fluorinated polymer such as Teflon or polyamide such as xylon.

The first fabric is substantially sealing. Typically, this is a fabric with a mesh size of less than 0.5 mm, preferably less than 0.2 mm. The second fabric is not sealing and allows molten metal to pass through. Typically, this is a fabric with a mesh size of between 1 and 5 mm, preferably 2 to 4 mm. In one embodiment of the invention, the first fabric locally covers the second fabric, while being in close contact so as to leave no gap between the two fabrics.

The slab obtained in this way is then homogenized before or after being optionally machined to obtain a shape that can be hot worked. In one embodiment, the slab is machined as a rolling ingot, so as then to be hot-worked by rolling. Preferably homogenisation is carried out at a temperature between 470 and 540° C. for a period of between 2 and 30 hours.

Said rolling ingot, homogenized in this way, is hot rolled and optionally cold rolled to obtain a wrought product having a thickness of at least 80 mm, The hot rolling temperature is preferably at least 350° C. and preferably at least 400° C. The hot-working and optionally cold-working ratio, i.e. the ratio between firstly the difference between the initial thickness before working, but after any machining, and the final thickness, and secondly the initial thickness, is less than 85% and preferably less than 80%. In an embodiment the deformation ratio during working is below 75% and preferably less than 70%.

The wrought product so obtained then undergoes solution heat-treatment and quenching. The solution heat-treatment temperature is advantageously between 470 and 540° C. and preferably between 490 and 530° C. and the time depend on the thickness of the product. Optionally said wrought product that has undergone solution heat treatment is stress-relieved by plastic deformation with a deformation of at least 1%, It is advantageous to stress-relieve said wrought product that has undergone solution heat-treatment by controlled stretching with a permanent elongation of at least 1% and preferably between 2 and 5%.

Finally said solution heat-treated and optionally stress relieved product is subjected to aging. Aging is carried out in one or more stages at a temperature preferably between 130 and 160° C. for a period of 5 to 60 hours. Preferably, a T8 temper, such as T851, T83, T84, or T85 is obtained after aging.

The plates having a thickness of at least 80 mm obtained by the method according to the invention have advantageous properties.

The fatigue logarithmic mean of plates whose thickness is at least 80 mm, obtained by the method according to the invention, measured at mid-thickness in the LT direction on smooth test samples according to FIG. 1*a* at a maximum stress amplitude of 242 MPa, a frequency of 50 Hz and a stress ratio R=0.1 is at least 250,000 cycles; advantageously the fatigue property is obtained for wrought products obtained by the method according to the invention with a thickness of at least 100 mm, or preferably at least 120 mm or even at least 140 mm.

Plates according to the invention of at least 80 mm thickness also have advantageous fatigue properties for notched test samples, and the fatigue quality index FQI obtained on notched test samples Kt=2.3 according to FIG. 1*b* at a frequency of 50 Hz in ambient air with a value R=0.1 is at least 180 MPa and preferably at least 190 MPa in the T-L direction.

Moreover, the plates obtained by the method according to the invention have advantageous static mechanical properties. For wrought products whose thickness is at least 80 mm comprising, as a percentage by weight, Cu: 3.0-3.9; Li: 0.7-1.3; Mg: 0.1 to 1.0, at least one element selected from Zr, Mn and Ti, the amount of said element, if selected, is from 0.06 to 0.15 wt % for Zr, 0.05 to 0.8 wt % for Mn and 0.01 to 0.15% by weight for Ti; Ag: 0 to 0.7; Zn≤0.25; Si≤0.08; Fe≤0.10; others ≤0.05 each and ≤0.15 in total, remainder aluminium, the yield stress measured at a quarter thickness in the L direction is at least 450 MPa and preferably at least 470 MPa and/the ultimate tensile strength measured is at least 480 MPa and preferably at least 500 MPa and/or elongation is at least 5% and preferably at least 6%. Preferably, the fracture toughness of wrought products according to the invention, whose thickness is at least 80 mm, measured at quarter thickness, is such that $K_{1C}$ (L-T) is at least 25 MPa√m, and preferably at least 27 MPa√m, K1C (T-L) is at least 23 MPa√m, and preferably at least 25 MPa√m, K1C (S-L) is at least 19 MPa√m, and preferably at least 21 MPa√m.

Plates according to the invention can advantageously be used for producing structural elements, preferably aircraft structural elements. Preferred aircraft structural elements are spars, ribs or fuselage frames. The invention is particularly advantageous for components of complex shape obtained by integral machining, used in particular for the manufacture of aircraft wings, as well as for any other use for which the properties of the products according to the invention are advantageous.

Example

In this example, thick AA2050 alloy plates were prepared. AA2050 alloy slabs were cast by semi-continuous vertical direct chill casting.

The alloy was prepared in a smelter. For examples 1 to 7 a KCL/LiCl mixture was used on the surface of the liquid metal in the smelter. For examples 8 to 9 no salt was used in the smelter. For examples 8 to 9 the atmosphere in contact with the liquid metal had an oxygen content of less than 0.3% by volume for the whole casting facility. The casting facility included a hood arranged above the casting pit to limit the oxygen content. For tests 8 and 9 a suction system (101) was additionally used, such that the pressure in the containment (10) was lower than the pressure in the chamber (65) and such that the velocity of the air through the open surfaces of the casting pit was at least 2 m/s. The oxygen content was measured using an oxygen analyser during casting. In addition, the hydrogen content in the liquid aluminium was measured using an Alscan™ type probe with nitrogen scanning. Two types of molten metal distributor device were used. A first distributor device of the "Combo Bag" type as described for example in FIGS. 2-6 of international application WO99/44719 which is hereby incorporated by reference in its entirety, but made from a fabric comprising of carbon, referred to below as "distributor device A", and a second distributor device such as described in FIG. 3 below, referred to as "distributor device B", is made from graphite wire fabric.

The casting conditions for the various tests are given in table 1.

TABLE 1

Casting conditions for the various tests

| Test | H2 [ml/100 g] | O2 measured above the casting pit (% by volume) | Distributor device |
|---|---|---|---|
| 1 | 0.41 | 0.3 | A |
| 2 | 0.43 | 0.1 | A |
| 3 | 0.37 | 0.1 | A |
| 4 | 0.33 | 0.1 | A |
| 5 | 0.35 | 0.4 | A |
| 6 | 0.38 | 0.3 | A |
| 7 | 0.47 | 0.7 | B |
| 8 | 0.34 | 0.1 | B |
| 9 | 0.29 | 0.1 | B |

The slabs were homogenized for 12 hours at 505° C., machined to a thickness of about 365 mm, hot-rolled to obtain plates with a final thickness of between 154 and 158 mm, solution heat-treated at 504° C., hardened and stress relieved by controlled stretching with a permanent elongation of 3.5%. The plates obtained in this way underwent aging for 18 hours at 155° C. The grain structure of the plates was substantially unrecrystallized, having a fraction of recrystallized grains less than 20%.

The static mechanical properties and fracture toughness were characterized at a quarter thickness. The static mechanical properties and fracture toughness are given in Table 2.

TABLE 2

Mechanical properties

| Test | Thickness [mm] | Rm (L) MPa | Rp0.2 (L) MPa | A % (L) | $K_{1C}$ (L-T) MPa√m | $K_{1C}$ (T-L) MPa√m | $K_{1C}$ (S-L) MPa√m |
|---|---|---|---|---|---|---|---|
| 1 | 158 | 528 | 495 | 6.5 | 31.7 | 27.8 | 24.2 |
| 2 | 155 | 538 | 507 | 7.0 | | | |
| 3 | 155 | 525 | 493 | 8.3 | 28.3 | 25.5 | 25.3 |
| 4 | 158 | 528 | 497 | 7.0 | 29.0 | 27.0 | 22.5 |
| 5 | 158 | 529 | 495 | 6.0 | 28.0 | 25.8 | 23.0 |
| 6 | 158 | 527 | 496 | 6.8 | 29.0 | 26.9 | 23.2 |
| 7 | 154 | 514 | 486 | 8.3 | 29.9 | 25.7 | 23.0 |
| 8 | 158 | 533 | 502 | 6.3 | 27.4 | 26.2 | 23.9 |
| 9 | 158 | 542 | 512 | 5.8 | 28.0 | 25.6 | 21.5 |

Fatigue properties were characterized on smooth test samples and on notched test samples for some samples taken at mid-thickness.

For smooth fatigue characterizations, four test samples, shown as a diagram in FIG. 1*a*, were tested at mid-thickness and mid-width in the LT direction, the test conditions being σ=242 MPa, R=0.1. Some tests were stopped after 200,000 cycles and other tests were stopped after 300,000 cycles.

Figure 6A:
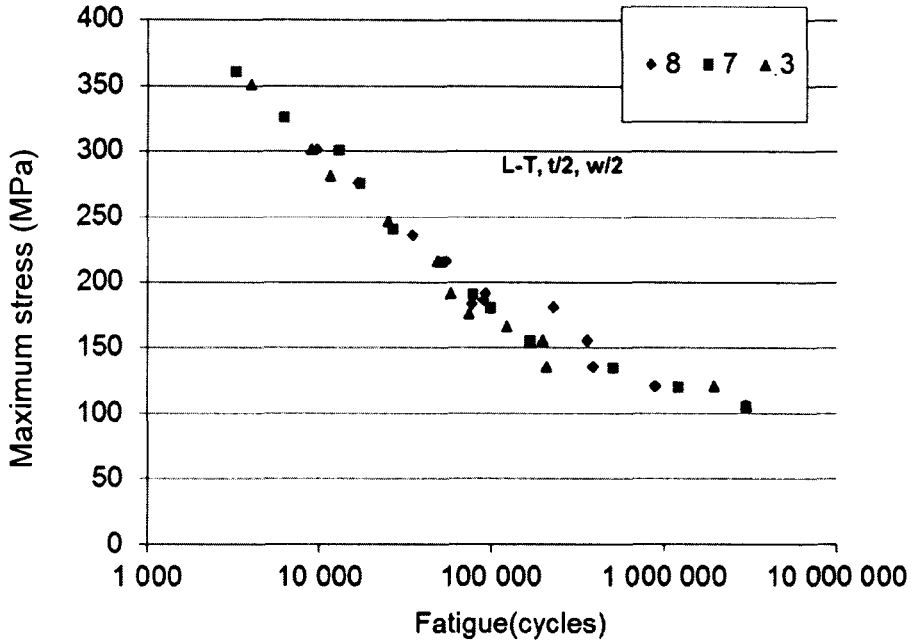
FIG. 6 shows the Wöhler curves obtained with tests 3, 7 and 8 in direction L-T (FIG. 6*a*) and T-L (FIG. 6*b*).
Figure 6B:
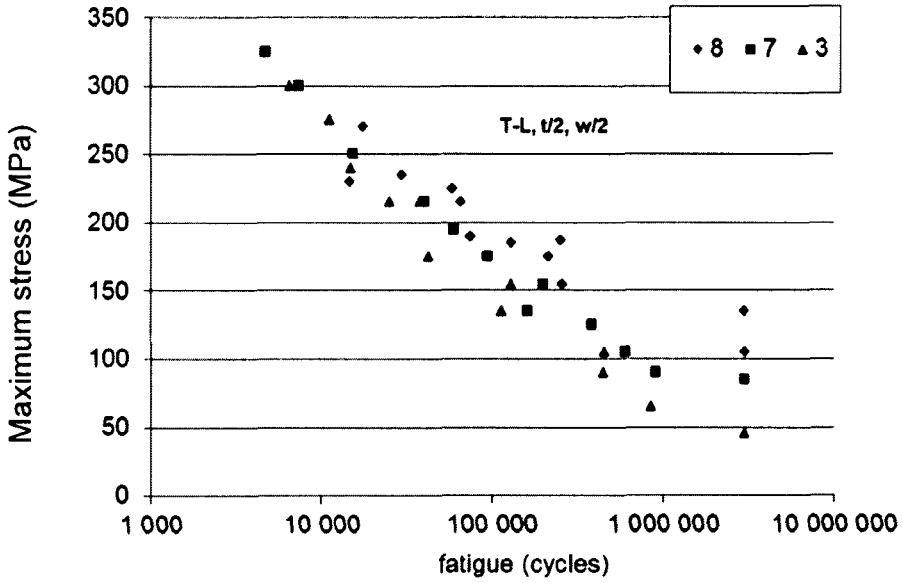

For notched fatigue characterizations, the test piece shown in FIG. 1*b*, whose $K_t$ value is 2.3, was used. The test samples were tested at a frequency of 50 Hz in ambient air with R=0.1. The corresponding Wöhler curves are shown in FIGS. 6*a* and 6*b*. The fatigue quality index IQF was calculated.

TABLE 3

Results of fatigue tests

| Test | Results for smooth fatigue (number of cycles) Test piece 1 | Test piece 2 | Test piece 3 | Test piece 4 | Logarithmic mean | Results for notched fatigue IQF (MPa), 50% rupture for 100,000 cycles L-T | T-L |
|---|---|---|---|---|---|---|---|
| 1 | 101423 | 101761 | 116820 | 118212 | 109263 | | |
| 2 | 102570 | 140030 | 152120 | 178860 | 140600 | | |
| 3 | 112453 | 163422 | 152620 | 167113 | 147138 | 175 | 152 |
| 4 | 101900 | 110300 | 139400 | 144100 | 122580 | | |
| 5 | 93400 | 105000 | 112600 | 129900 | 109439 | | |
| 6 | 114000 | 116500 | 188100 | 195000 | 148564 | | |
| 7 | 192300 | >200000 | 189600 | >200000 | >195400 | 183 | 168 |
| 8 | >300000 | >300000 | >300000 | >300000 | >300000 | 186 | 196 |
| 9 | >300000 | >300000 | >300000 | >300000 | >300000 | | |

Figure 5A:
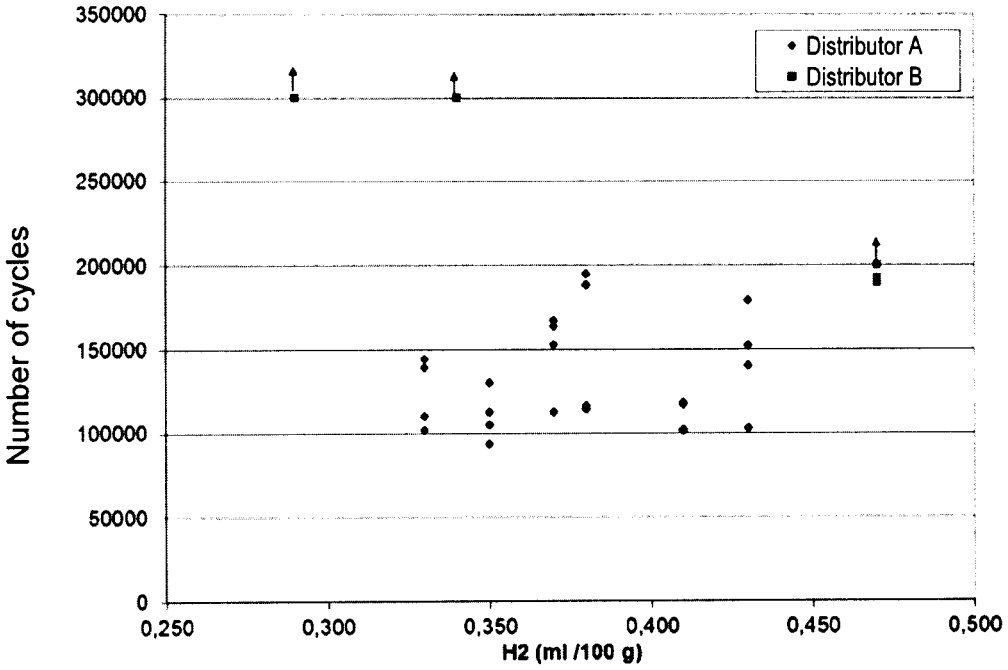
FIG. 5 shows the relationship between smooth fatigue performance and the hydrogen content of the bath of molten metal during solidification (FIG. 5*a*) or the oxygen content measured above the liquid surface during solidification (FIG. 5*b*).
Figure 5B:
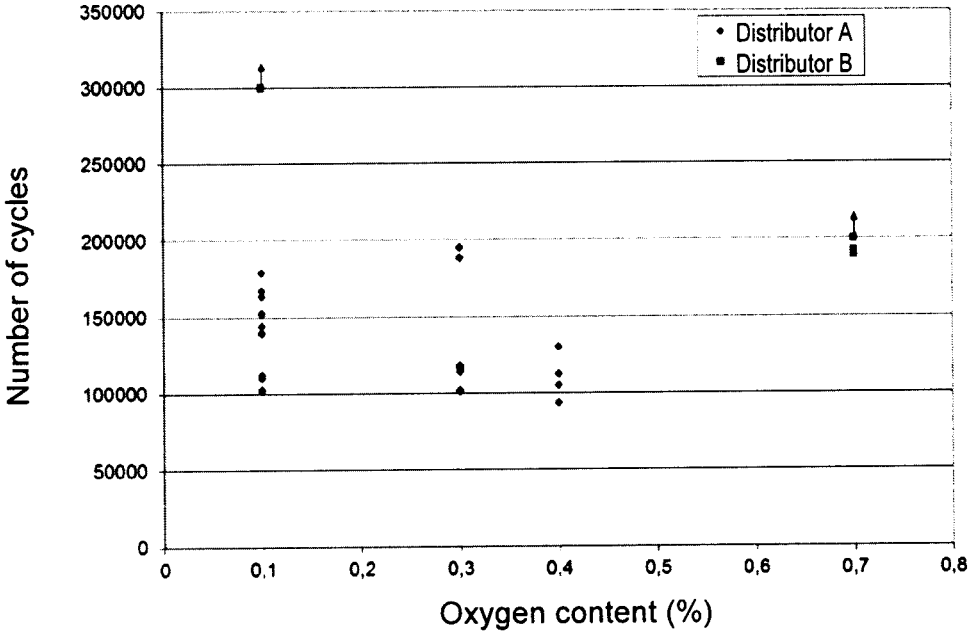

The combination of a hydrogen content of less than 0.4 ml/100 g, an oxygen content measured above the liquid surface of less than 0.3% by volume, and distributor device B gives a high level of fatigue performance. These results are shown in FIG. 5. The arrows positioned above certain points indicate that this is a minimum value since the test was not continued until failure.

The invention claimed is:

1. An aged state aged plate having a thickness of at least about 80 mm, made of AA2050 aluminium alloy wherein in the aged state, its fatigue logarithmic mean measured at mid-thickness in the LT direction on smooth test samples as shown in FIG. 1*a* with a maximum stress amplitude of 242 MPa, a frequency of 50 Hz, a stress ratio of R=0.1 is at least 250,000 cycles, wherein the plate is obtained by a method comprising steps wherein (a) a bath of AA2050 molten alloy metal is prepared, (b) said alloy is cast by semi-continuous vertical casting to obtain a slab of thickness T and width W so that upon solidification, the hydrogen content of said molten metal bath is less than about 0.4 ml/100 g, the oxygen content measured above the liquid surface is less than about 0.5% by volume, wherein said method utilizes a distributor device for casting, and wherein said distributor device is made of fabric comprising carbon, a lower face, an upper face defining the opening through which the molten metal is introduced, and a wall, the wall comprising two longitudinal portions parallel with width W and two transverse portions parallel with thickness T, said transverse and longitudinal portions being formed of at least two materials, a first substantially sealing material and semi-rigid material for maintaining the shape of the distributor device during casting and a second non-sealing material allowing the passage and filtration of liquid, said first and second materials being bonded to each other without overlap or with overlap and no gap separating them, said first material continuously covering at least about 30% of the surface of said wall portions and being positioned so that the liquid surface is in contact therewith, (c) said slab is homogenized before or after optionally machining it to get a rolling ingot that can be hot-worked, (d) said rolling ingot, homogenized in this way, is hot rolled and optionally cold rolled to obtain a plate having a thickness of at least about 80 mm, (e) said plate undergoes solution heat treatment and quenching, (f) optionally said plate that has undergone solution heat treatment is stress-relieved by plastic deformation with a deformation of at least 1%, and (g) said solution heat-treated and optionally stress-relieved plate is subjected to aging;

and a molten salt containing lithium is not used throughout the entire casting facility.

2. The plate according to claim 1, wherein the oxygen content of the atmosphere in contact with the liquid metal bath in the smelter during the degassing step, filtration is less than about 0.5% by volume.

3. The plate according to claim 1, wherein a lid covers the liquid surface during solidification, and wherein an inert gas is introduced into the chamber defined between the lid and the casting table and wherein suction is maintained in the casting pit by means of a pump, optionally so that the pressure within the containment is less than the pressure in the chamber.

4. The plate according to claim 3, wherein said lid comprises seals to ensure a leak tight seal with the casting table.

5. The plate according to claim 1, in which said distributor device is such that the first material has a height h1 as measured from the upper face on the circumference of the wall such that h1≥0.3 h, where h is the total height of the wall of the distributor device.

6. The plate according to claim 5, wherein h1≥0.5 h, where h is the total height of the wall of the distributor device.

7. The plate according to claim 1, in which the height of the wall immersed in the liquid metal of the distributor device covered by the first material is selected from the group consisting of at least about 20%, about 40%, and about 60% of the total height of the immersed wall.

8. The plate according to claim 1, in which the surface portion covered by the first material is from about 30 to about 90% for the longitudinal portions, and/or from about 30 to about 70% for the lateral portions, and/or from about 30 to about 100% for the bottom.

9. The plate according to claim 8, in which the surface portion covered by the first material is from about 50 to about 80% for the longitudinal portions and/or from about 40 to about 60% for the lateral portions, and/or from about 50 to about 80% for the bottom.

10. The plate according to claim 1, in which the deformation ratio during step (d) is lower than about 85%.

11. Plate according to claim 1, wherein said thickness is at least about 100 mm.

12. Plate according to claim 1, wherein said thickness is at least about 120 mm.

13. Plate according claim 1, characterized in that its yield stress measured at a quarter thickness in the L direction is at least 450 MPa.

14. Product according to claim 1, wherein said fracture toughness measured at quarter thickness, exhibits a $K_{1C}$ (L-T) selected from the group consisting of at least 25 MPa√m and at least 27 MPa√m;

a K1C (T-L) selected from the group consisting of at least 23 MPa√m and at least 25 MPa√m; and/or a K1C (S-L) selected from the group consisting of at least 19 MPa√m and at least 21 MPa√m.

15. Product according to claim 1, wherein said fatigue quality index FQI obtained on notched test samples Kt=2.3 at a frequency of 50 Hz in ambient air with a value R=0.1 is selected from the group consisting of at least 180 MPa and at least 190 MPa in the T-L direction.

16. A plate of claim 1, wherein said fabric comprises about 90% or more of carbon.

17. Plate according to claim 1, wherein an inert gas selected from the group consisting of rare gases, nitrogen, and carbon dioxide, or mixtures of these gases, is used the casting process.

18. Plate according to claim 17, wherein the inert gas is argon.

19. The plate according to claim 1, wherein the oxygen content of the atmosphere in contact with the liquid metal bath is less than about 0.5% by volume for the entire casting facility.

20. An aged state plate having a thickness of at least about 80 mm, wherein said plate comprises AA2050 aluminium alloy, wherein in the aged state the fatigue logarithmic mean measured at mid-thickness in the LT direction on smooth test samples exhibits a maximum stress amplitude of 242 MPa, a frequency of 50 Hz, and a stress ratio of R=0.1 of at least 250,000 cycles.

21. Plate according to claim 20, wherein the yield stress measured at a quarter thickness in the L direction is at least 450 MPa.

* * * * *